US010605559B2

(12) United States Patent
Summers et al.

(10) Patent No.: US 10,605,559 B2
(45) Date of Patent: Mar. 31, 2020

(54) ARCHERY BOW STABILIZER

(71) Applicant: Gregory E. Summers, Madison Heights, VA (US)

(72) Inventors: Gregory E. Summers, Amherst, VA (US); Tristan Mason, Madison Heights, VA (US); Marc T. Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 15/975,180

(22) Filed: May 9, 2018

(65) Prior Publication Data

US 2019/0346230 A1 Nov. 14, 2019

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
See application file for complete search history.

(56) References Cited

U.S. PATENT DOCUMENTS

| | | | | |
|---|---|---|---|---|
| 4,395,159 | A * | 7/1983 | Karuks | B28B 19/0038 138/103 |
| 4,840,826 | A * | 6/1989 | Shirasaki | B29C 70/08 138/137 |
| 6,718,964 | B1 * | 4/2004 | Graf | F41B 5/1426 124/89 |
| 6,997,174 | B2 * | 2/2006 | Sandberg | F41B 5/1426 124/89 |
| 9,766,033 | B2 * | 9/2017 | Powell | F41B 5/1426 |
| 2010/0084036 | A1 * | 4/2010 | Le Morvan | F16L 9/12 138/109 |
| 2012/0240913 | A1 * | 9/2012 | Stokes | F41B 5/1426 124/89 |

* cited by examiner

*Primary Examiner* — John A Ricci
(74) *Attorney, Agent, or Firm* — Laubscher & Laubscher, P.C.

(57) ABSTRACT

An archery bow stabilizer includes an elongated tube formed of at least two concentric layers of alternating stiffness or rigidity. The layers are formed of different materials, one have a low degree of stiffness and the other having a higher degree of stiffness relative to the material of low stiffness. The low stiffness material is a natural fiber material and the high stiffness material is a metal or composite material.

13 Claims, 1 Drawing Sheet

ARCHERY BOW STABILIZER

BACKGROUND OF THE DISCLOSURE

Professional archers often use a stabilizer with their bow to improve their accuracy. Similarly, hunters may also use a stabilizer as well. A stabilizer is typically screwed into an accessory hole on the bow, whether it by a compound or an Olympic bow. The stabilizer resists torque and absorbs vibrations in the bow when shot, thereby reducing the shock felt in the archer's hand on the bow grip. It also helps keep the bow balanced and settles the archer's arm during aiming.

Stabilizers are offered in different lengths and usually include adjustable weights so that they can be selected in accordance with particular preferences of the archer.

BRIEF DESCRIPTION OF THE PRIOR ART

Bow stabilizers are well-known in the prior art as evidenced by the Stokes US patent application publication No. 2012/0240913. The stabilizer described in this publication includes a hollow, tubular elongated member which has first and second portions of different rigidity or stiffness along the length thereof. The first portion is adapted to flex in order to absorb shock when the bow is shot. The second portion is more stiff and the minimize movement when the bow is shot. Both portions include a core layer and a cover layer. However, in the first more flexible section, the cover layer is formed of a light fabric while in the second more stiff section, the cover layer is formed of a dense fabric.

While the prior stabilizers operate satisfactorily, they are limited in their ability to dampen vibrations. The core disclosed in Stokes is formed of a laminated carbon prepreg or other lightweight carbon or composite material including fiberglass, resin impregnated fabric, aluminum tubing or a combination of these materials. The cover material is a fabric, with the second section cover material being different and denser than the first section cover material. The second section cover material may include a layer of metal screen, foil or a thin metal tube in addition to the fabric material. However, whatever combination of materials is used is limited in its damping characteristics.

SUMMARY OF THE DISCLOSURE

The stabilizer according to the invention includes an elongated member or tube formed of at least two layers of material which alternate in stiffness or rigidity from the core to the exterior.

In a first embodiment, two concentric layers of material are provided and extend continuously between the ends of the tube. The layers are formed of first and second materials having different degrees of stiffness or rigidity. One of the materials is a natural fiber, preferably flax. The other material is a metal, preferably a carbon fiber material. If the inner layer material has a high degree of stiffness, the outer layer material has a lower degree of stiffness relative to the inner layer. If the inner layer of material has low degree of stiffness, the outer layer material has a higher degree of stiffness relative to the inner layer.

In another embodiment, at least three layers of material are provided with some of the layers formed of a first material having a low degree of stiffness and one or more of the other layers formed of a second material having a higher degree of stiffness relative to the first degree of stiffness. If the innermost layer of the tube is formed of a low stiffness material, then it is surrounded by a layer of higher material which is in turn surrounded by a layer of the low stiffness material. Additional layers may be provided, but they preferably alternate in degrees of stiffness.

Alternatively, the innermost layer may be formed of the material of a higher degree of stiffness. In this case, the next outer layer is formed of a low stiffness material and the next outer layer is formed of a higher stiffness material.

The material having a low degree of stiffness is preferably a natural fiber material such as flax and the material having a higher degree of stiffness is preferably a composite and/or metal material such as carbon fiber.

Each layer of material may include sublayers of material having a similar degree of stiffness. Thus, at two adjacent layers of a material having a low degree of rigidity or stiffness may be covered by two or more layers of a material having a higher degree of stiffness which in turn are covered by two or more layers of material having a low degree of stiffness. In any case, at least three layers, whether they include a single layer or multiple sublayers, are provided with the layers alternating in degrees of stiffness from the core of the tube to the exterior of the tube.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
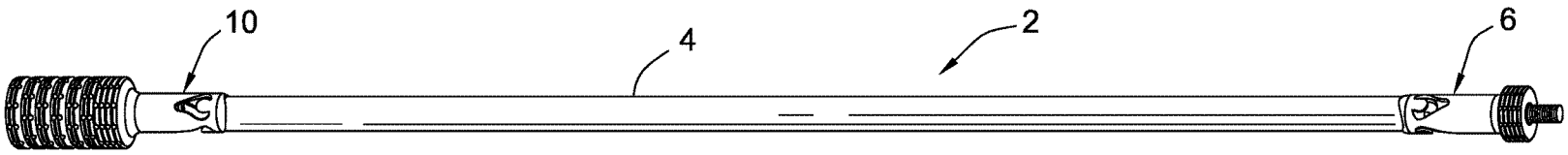
FIG. 1 is a front perspective view of an archery bow stabilizer according to the disclosure.
Figure 2:
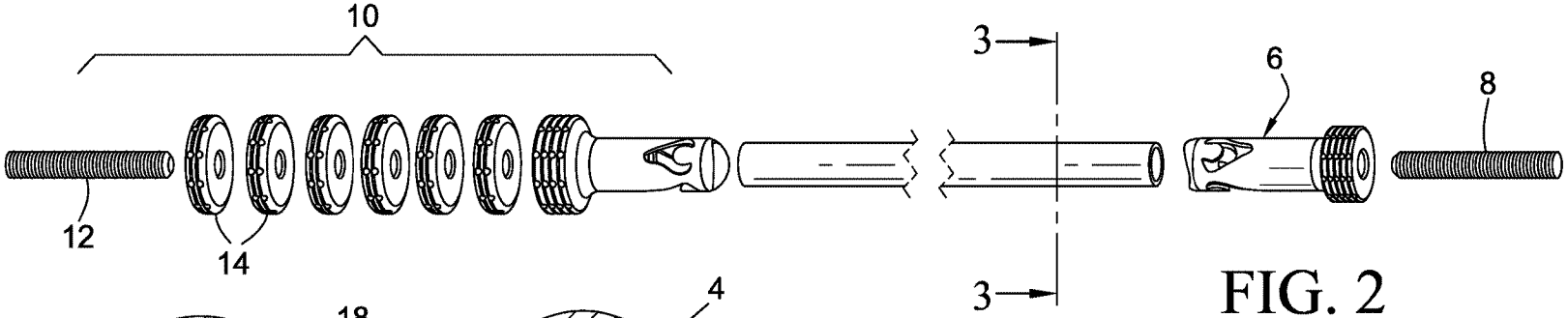
FIG. 2 is an exploded view of the stabilizer of FIG. 1.

The archery bow stabilizer 2 according to the disclosure as shown in FIGS. 1 and 2 includes an elongated member 4 which is preferably a cylindrical tube having a circular cross-section. Other cross-sectional configurations, such as elliptical, oval, square or rectangular, of the tube may be provided. The tube is preferably hollow and formed of multiple concentric layers of material as will be described below in connection with FIGS. 3-8. Alternatively, the tube may have a solid construction.

At one end, the tube includes a connector 6 including a threaded extension 8 coaxial with the member or tube for connecting the stabilizer with a bow (not shown). As is known in the art, the threaded extension is screwed into a threaded opening in the bow, although other types of connection may be provided. The connector is connected with an end of the member in a conventional manner such as via a plug-fit, weld or adhesive connection. At the other end of the member 4, and adjustable weight assembly 10 is connected with the member via a similar connection as the connector. The weight assembly includes a threaded member 12 which is coaxial with the member or tube for receiving a plurality of weights 14 having a central threaded opening. It will be apparent to those of ordinary skill in the art that the weight of the stabilizer can be adjusted according to the preferences of an archer by adding or removing weights 14 from the end of the stabilizer.

The member or tube of the stabilizer may be provided in different lengths. By way of example only, the length of the tube may be between eight and thirty-six inches, again depending on the preferences of the archer.

Figure 3:
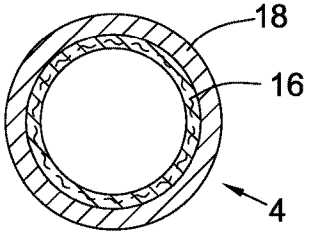
FIG. 3 is a sectional view of the stabilizer tube taken along lines 3-3 of FIG. 2.

Referring now to FIG. 3, the composition of the member or tube 4 will be described. As noted above, the tube is preferably hollow and includes in cross-section a plurality of concentric layers. In all embodiments, at least two layers are formed with the layers having alternating degrees of stiffness or rigidity from the interior layer to the outermost layer. Some of the layers are formed of a material having a low degree of stiffness and other layers have a higher degree of stiffness with respect to the low degree of stiffness.

Examples of materials having a low degree of stiffness are natural fiber materials. A preferred material natural fiber material is flax, but other natural fibers may be used as well. These materials may be woven in a dry state of non-crimp unidirectional fabric and/or impregnated with other materials. By way of example only, a flax fiber linen dry fabric having a weight of 275 g/m$^2$ has the following characteristics:

| | | |
|---|---|---|
| Tensile modulus parallel to fibers | 32 gpa | 4.6 msi |
| Tensile modulus perpendicular to fibers | 3.2 gpa | 464 ksi |
| Tensile strength parallel to fibers | 383 mpa | 55.5 ksi |
| Tensile strength perpendicular to fibers | 22 mpa | 3.2 ksi |
| Tensile strain to failure parallel to fibers | 1.7% | |
| Tensile strain to failure perpendicular to fibers | 0.6% | |

| | | |
|---|---|---|
| Flexural modulus parallel to fibers | 26 gpa | 3.77 msi |
| Flexural modulus perpendicular to fibers | 3.7 gpa | 536 ksi |
| Flexural strength parallel to fibers | 330 mpa | 47.8 ksi |
| Flexural strength perpendicular to fibers | 42 mpa | 6.1 ksi |
| Flexural yield strength parallel to fibers | 209 mpa | 30.1 ksi |

The natural fiber may also be reinforced with pre-impregnated composite materials. For example, such a material having a fabric weight of 3.2 oz/yd$^2$ has the following characteristics:

| | | |
|---|---|---|
| Tensile strength 0° ASTM D3039 | 3916 mpa | 56.8 ksi |
| Tensile modulus 0° ASTM D3039 | 38.3 gpa | 5.6 msi |

| | | |
|---|---|---|
| Flexural strength 0° ASTM D7264 | 279.2 mpa | 40.5 ksi |
| Flexural modulus 0° ASTM D7264 | 43.5 gpa | 5.0 msi |

The natural fiber may also be incorporated into a tape. For example, a composite made with twelve layers of natural fiber tape and an epoxy resin has the following characteristics:

| | | |
|---|---|---|
| Rate of fibers | By volume | 50% |

| | | |
|---|---|---|
| Traction (ISO 527) | Modulus | 35 gpa |
| Traction (ISO 527) | Tensile Strength | 365 mpa |
| Traction (ISO 527) | Failure Strain | 1.35% |
| Flexion (ISO 14 125) | Modulus | 31 gpa |
| Flexion (ISO 14 125) | Tensile Strength | 294 mpa |
| Flexion (ISO 14 125) | Failure Strain | 2.6% |

| | |
|---|---|
| Theoric Density | 1.31 gr/cm$^3$ |

The dampening ratio for the above composite natural fiber tape is 1.47%.

Examples of materials having a higher degree of stiffness are metals or composite materials such as fiberglass. Suitable metals are carbon and aluminum. According to a preferred embodiment, the material having a higher degree of stiffness is a carbon fiber, a high modulus carbon, or a woven carbon fiber such as carbon fiber twill. The tensile modulus of standard carbon materials is 33 msi and the tensile modulus of ultra-high modulus carbon is 110 msi. The dampening ratio of carbon is 0.18% and the dampening ratio of glass is 0.15%. Thus, the dampening ration of the natural fiber material is significantly higher than those of carbon or glass.

Figure 4:
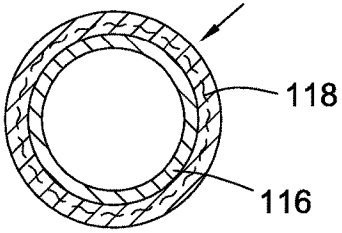
FIGS. 4-8 are sectional views of a stabilizer tube according to alternate embodiments, respectively.

In the embodiment shown in FIG. 3, the innermost layer of material 16 is a material having a low degree of stiffness and the outermost layer 18 is a material having a high degree of stiffness. These layers extend continuously between the ends of the tube 4. The layers are contiguous and concentrically arranged relative to the axis of the tube. FIG. 4 is an embodiment of the stabilizer tube 104 which is essentially the opposite of the embodiment of the tube of FIG. 3. In FIG. 4, the inner layer 116 is formed of a material such as a metal having a high degree of stiffness and the outer layer 118 is formed of a material such as a natural fiber having a low degree of stiffness.

Figure 5:
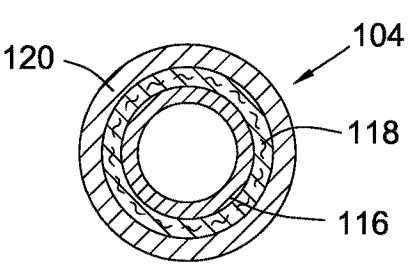

In the embodiment shown in FIG. 5, a three layer tube 104 is shown. The innermost layer of material 116 is a material having a high degree of stiffness. It is followed by a middle layer of material 118 which has a low degree of stiffness. Lastly, the outermost layer 120 has a high degree of stiffness. The inner and outer layers 116, 120 may be formed of the same material. Alternatively, they may be formed of different materials which have similar degrees of stiffness, so long as the stiffness is relatively high relative to the stiffness of the middle layer 118.

Figure 6:
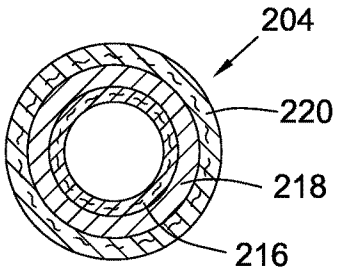

In the embodiment shown in FIG. 6, the tube 204 has an inner layer of material 216 having a low degree of stiffness, the middle layer 218 has a high degree of stiffness, and the outer layer 220 has a low degree of stiffness. The inner and outer layer may be the same material, but they need not be so long as they have similarly low degrees of stiffness in relation to the degree of stiffness of the middle layer 218.

Figure 7:
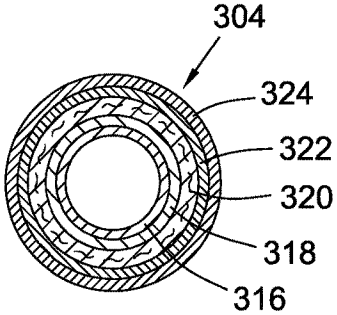

In the embodiment shown in FIG. 7, the layers 316 and 318 of the tube or member 304 form sublayers of a first innermost layer of material having a high degree of stiffness. The next layer 320 is a single layer of material having a low degree of stiffness. The next outer layers 322 and 324 are sublayers of material having a high degree of stiffness. In this embodiment, the sublayers 316, 318, 322, and 324 may all be formed of the same material or of different materials having similar degrees of stiffness which are higher than the degree of stiffness of the layer 320.

Figure 8:
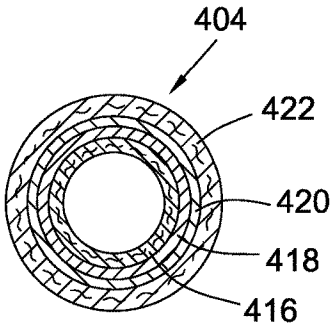

FIG. 8 is a cross-section of a further embodiment of a tube or member 404 having an inner layer 416 of material having a low degree of stiffness, sublayers 418 and 420 of materials having a high degree of stiffness, and an outer layer 422 of material having a low degree of stiffness.

In each embodiment, the layers of material which form the member or tube are connected with each other using conventional techniques such as thermos-welding, adhesive, and the like. The outermost layer may be painted or otherwise coated to provide a desired appearance to the stabilizer.

Incorporating a natural fiber material into the stabilizer tube increases the damping ability of the stabilizer. By alternating natural fiber layers with harder metal layers, a composite stabilized with enhanced vibration reduction is provided. The ordering of the layers from the interior of the tube to the exterior is less significant than the alternate layering of stiff and less stiff materials totaling at least three layers.

While the preferred forms and embodiments of the archery stabilizer tube have been illustrated and described, it will be apparent to those of ordinary skill in the art that various changes and modifications may be made without deviating from the novel concepts thereof.

What is claimed is:

1. An archery bow stabilizer, comprising a vibration stabilizer tube formed of at least two concentric layers in cross-section, said layers extending continuously between ends of said tube and being formed of first and second vibration dampening materials having different dampening ratios, one of said materials comprising flax.

2. An archery bow stabilizer as defined in claim 1, wherein another of said materials comprises a metal.

3. An archery bow stabilizer as defined in claim 2, wherein said metal comprises carbon.

4. An archery bow stabilizer, comprising a tube formed of at least three layers in cross-section, said layers having alternating degrees of stiffness from an interior of said tube to an exterior of said tube, at least one of said layers being formed of material having a low degree of stiffness and at least one other layer or layers is formed of another material having a higher degree of stiffness with respect to the low degree of stiffness, said material having a low degree of stiffness comprising flax.

5. An archery bow stabilizer as defined in claim 4, wherein said material having a higher degree of stiffness comprises a metal.

6. An archery bow stabilizer as defined in claim 5, wherein said metal comprises carbon.

7. An archery bow stabilizer as defined in claim 4, wherein an innermost layer of said tube is formed from said material having a higher degree of stiffness.

8. An archery bow stabilizer as defined in claim 4, wherein an innermost layer of said tube is formed from said material having a low degree of stiffness.

9. An archery bow stabilizer as defined in claim 4, wherein each of said layers includes at least two sub-layers formed of materials having the same degree of stiffness.

10. An archery bow stabilizer as defined in claim 4, wherein said tube is hollow and has a cylindrical configuration.

11. An archery bow stabilizer as defined in claim 10, and further comprising a connector connected at another end of said tube for connecting said tube with a bow.

12. An archery bow stabilizer as defined in claim 4, and further comprising a weight connected with one end of said tube.

13. An archery bow stabilizer, comprising a vibration stabilizer tube formed of at least two concentric layers in cross-section, said layers extending continuously between ends of said tube and being formed of first and second materials having different dampening ratios, one of said materials comprising flax fibers and another of said materials comprising carbon.

* * * * *